US005762592A

United States Patent [19]

Neveux

[11] Patent Number: 5,762,592

[45] Date of Patent: Jun. 9, 1998

[54] STRETCH MACHINE FOR PHYSICAL THERAPY

[76] Inventor: Patrick Neveux, 1102 Republic Ct., Pompano Beach, Fla. 33073-1849

[21] Appl. No.: 705,298

[22] Filed: Aug. 29, 1996

[51] Int. Cl.[6] ..... A63B 21/00

[52] U.S. Cl. ..... 482/131; 482/907

[58] Field of Search ..... 482/132, 907, 482/131

[56] References Cited

U.S. PATENT DOCUMENTS

| | | | |
|---|---|---|---|
| 3,589,720 | 6/1971 | Agamian | 482/132 |
| 4,892,304 | 1/1990 | DeNiro . | |
| 4,979,732 | 12/1990 | Rushatz et al. . | |
| 5,066,005 | 11/1991 | Luecke | 482/132 |
| 5,067,709 | 11/1991 | Christianson . | |
| 5,122,106 | 6/1992 | Atwood et al. . | |
| 5,260,870 | 11/1993 | Tsuchiya et al. | 482/132 |
| 5,261,865 | 11/1993 | Trainor . | |
| 5,277,681 | 1/1994 | Holt . | |
| 5,328,426 | 7/1994 | Vendette . | |
| 5,518,484 | 5/1996 | Bruckenstein | 482/131 |

*Primary Examiner*—Lynne A. Reichard

*Attorney, Agent, or Firm*—Oltman, Flynn & Kubler

[57] ABSTRACT

A leg multi-muscle stretch apparatus for physical therapy includes a foot carriage mounted to a carriage guide track and permitting the foot carriage to move back and forth along a carriage path, for therapeutically stretching a user foot and user leg with reciprocating motion, and a user support structure pivotally connected the carriage track. The apparatus preferably additionally includes user handle grips, and two elongate arm members pivotally connected to the carriage guide track, where the handle grips are connected to the elongate arm members. The user support structure preferably includes a platform structure including two parallel and laterally spaced apart beam members and a planar web member extending between and supported by the beam members. The apparatus preferably additionally includes two cable and cable pulley mechanisms, each including a series of cables forming a cable loop extending along the user support structure, along the carriage guide track and along the arm members, and then back to the user support structure, and a series of pulleys rotatably mounted to the user support structure and to the carriage guide track for guiding the cable loop, the cable loop being connected to the foot carriage to reciprocate with the foot carriage.

10 Claims, 4 Drawing Sheets

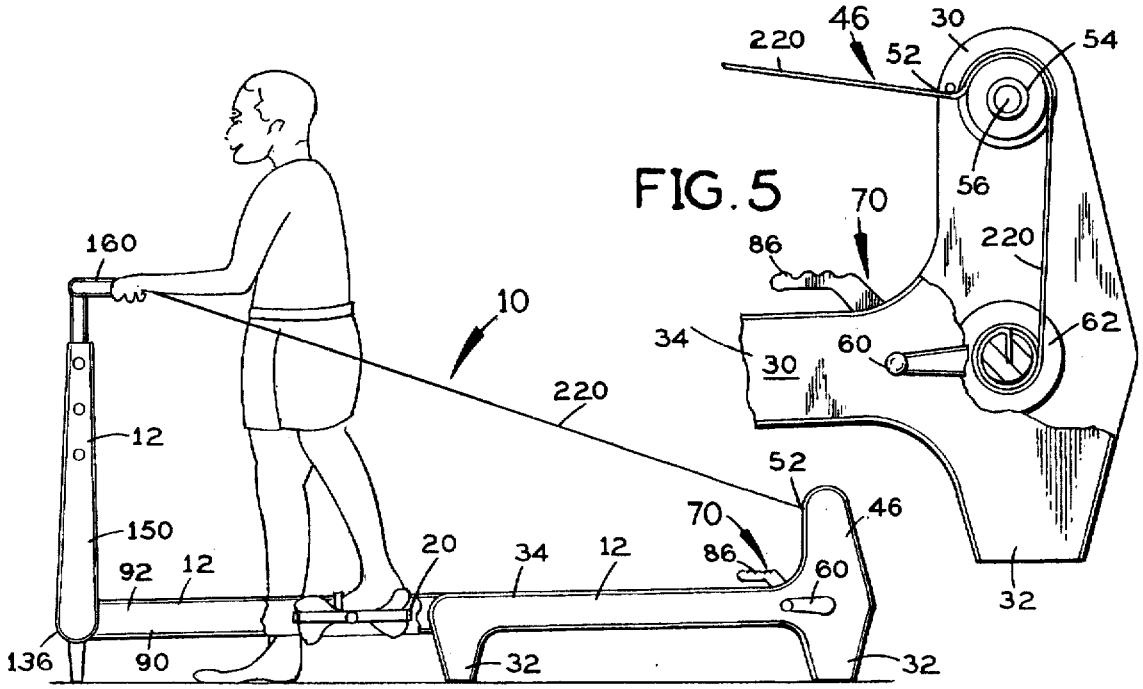
FIG. 20
FIG. 5
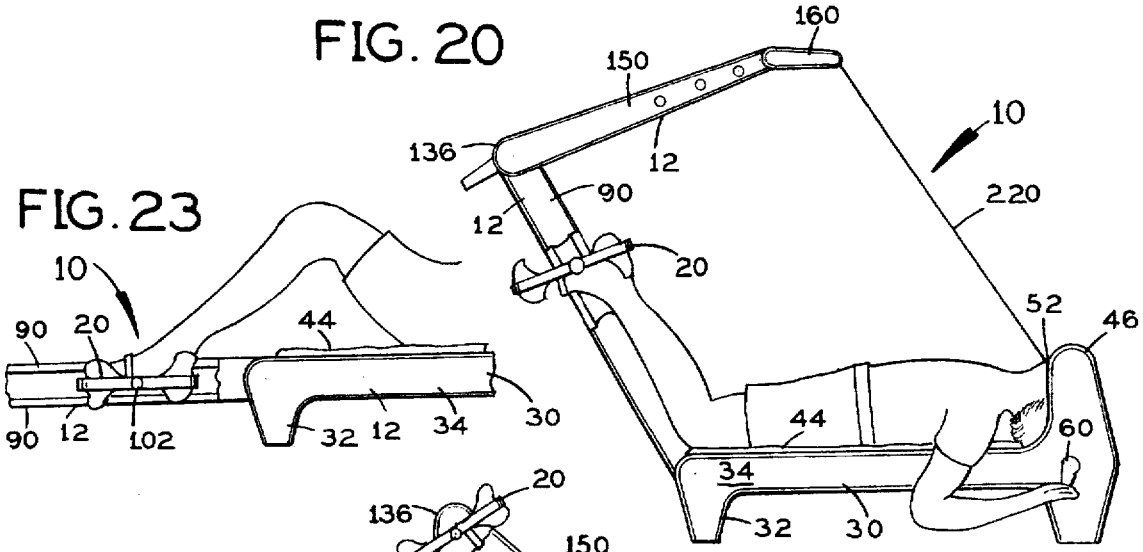
FIG. 21
FIG. 23
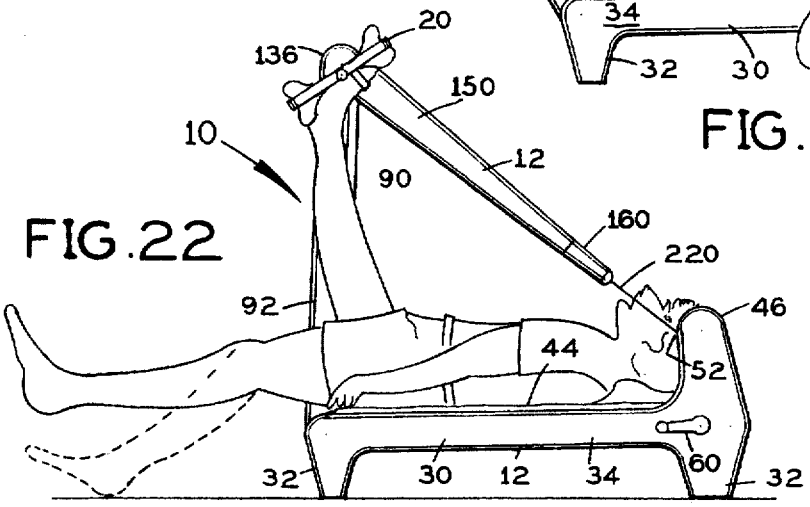
FIG. 22

FIG.6
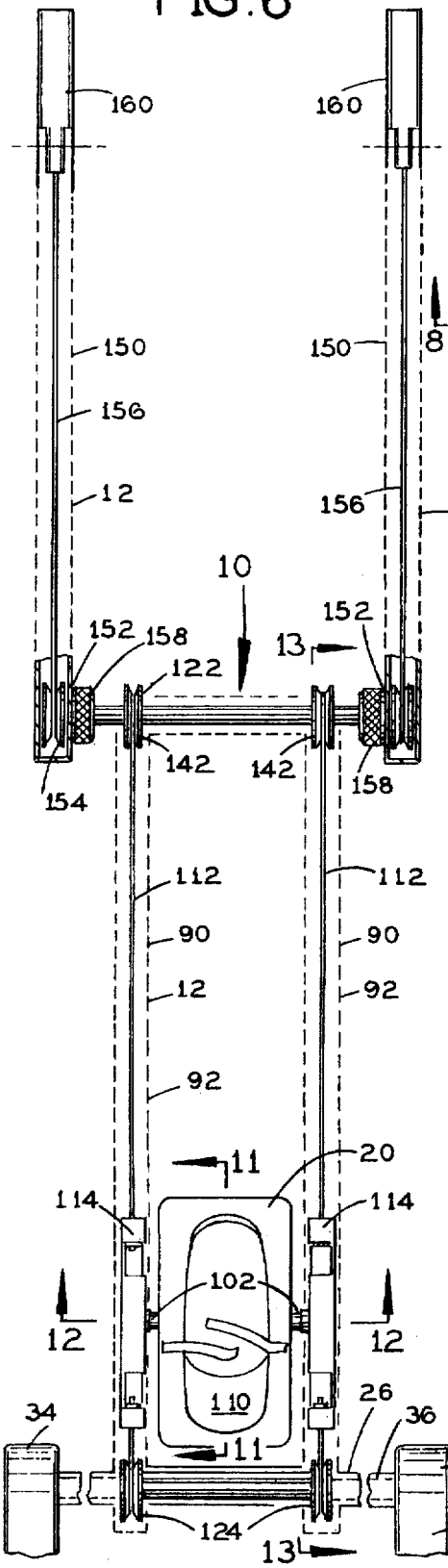
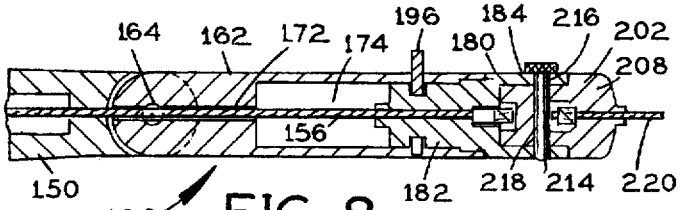
FIG.8
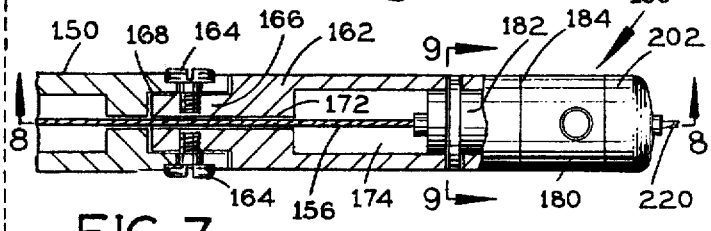
FIG.7
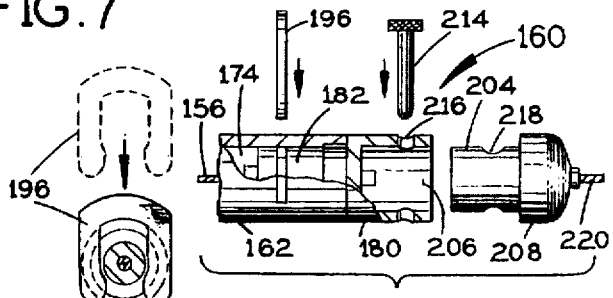
FIG.10
FIG.9
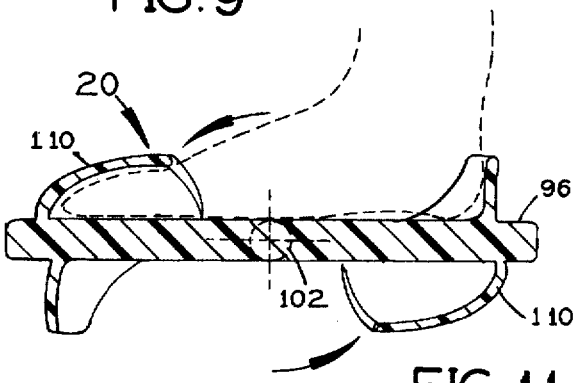
FIG.11
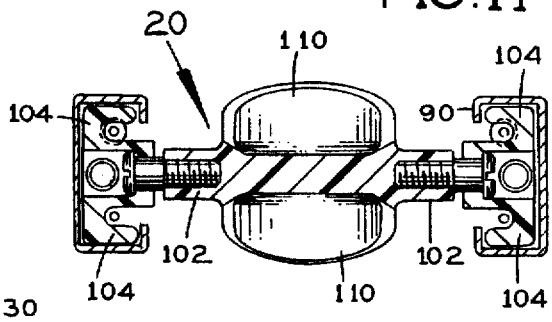
FIG.12

STRETCH MACHINE FOR PHYSICAL THERAPY

BACKGROUND OF THE INVENTION

1. Field of the Invention

The present invention relates generally to the field of physical therapy administering equipment. More specifically, the present invention relates to a leg stretch apparatus which provides a user body supporting frame made up of several frame portions. The frame portions are pivotally inter-connected to permit reconfiguration of the frame to position the user body in any of several specific stretch poses, while presenting a slidable foot carriage for guiding a user leg in a series of reciprocating leg movements.

The apparatus includes a torso support platform on which the user rests his or her chest or back for various stretch poses. Pivotally extending from a first end of the support platform is a foot carriage track made up of two parallel and laterally spaced apart guide rails on which a reciprocatable foot carriage rides. A pair of elongate tubular arm members pivotally extend from the carriage track opposite the support platform. Each arm member has a pivoting handle and grip structure at its free ends. A cable loop formed of an interconnected series of cables extends along the platform, along the carriage guide track and along the arm members, and then back to said user support platform. A series of pulleys are rotatably mounted to the platform, the guide track and arm members for guiding the cable loop. The cable loop is connected to the foot carriage to reciprocate with the foot carriage.

2. Description of the Prior Art

There have long been physical therapy devices for working various parts of the human body to help gain back full movement following an injury or in response to some other ailment. There are, for example, well-designed leg stretching. Yet there has been an absence of leg stretch devices which are well suited to the requirements of physical therapy with multi configuration capability.

DeNiro, U.S. Pat. No. 4,892,304, teaches an isotonic exercise apparatus for stretching and strengthening leg muscles of a user. The DeNiro apparatus includes a body support and an exercise leg support extending outwardly from the body support. The exercise leg support is hinged to allow a user to flex an leg being exercised at the knee.

Rushatz, et al., U.S. Pat. No. 4,979,732, issued on Dec. 25, 1990, discloses an exercise device and a method of using the device. Rushatz includes two hinged planar parts with a holding strap for the user to grip. The user assumes a prone face-up position on the device with the pelvic area being held by the strap thereby stabilizing the torso of the user. An aide assists in both holding down the device and in assisting in alternately raising the legs of the user thereby exercising groups of muscles.

Christianson, U.S. Pat. No. 5,067,709, issued on Nov. 26, 1991, reveals a device for stretching and strengthening the muscles of the lower back and legs of a person in a supine position. The device includes a board with straps to restrain the pelvis of the person. A rope and pulley system, operated by the person by pulling and releasing the rope extends between the feet and to a support above the head. The rope is pulled by the user to raise the legs. Some additional mechanical advantage is employed as the rope is gradually released to lower the legs.

Other related prior patents include Atwood, et al., U.S. Pat. No. 5,122,106, issued on Jun. 16, 1992, for a stretching apparatus; Trainor, U.S. Pat. No. 5,261,865, issued on Nov. 16, 1993, for a back strengthening device and method; Holt, U.S. Pat. No. 5,277,681, issued on Jan. 11, 1994, for a stretching exercise machine; and Vendette, U.S. Pat. No. 5,328,426, issued on Jul. 12, 1994, for a leg stretcher.

It is thus an object of the present invention to provide a physical therapy leg stretch apparatus which permits and provides for leg reciprocation stretch with a desired minimal level of resistance from any of several user positions and poses.

It is another object of the present invention to provide such an apparatus which is easily reconfigurable for supporting the user body in these various stretch positions and poses.

It is still another object of the present invention to provide such an apparatus which is foldable into a compact storage and transport configuration.

It is finally an object of the present invention to provide such an apparatus which is relative inexpensive to manufacture and can be made of light weight materials such as aluminum.

SUMMARY OF THE INVENTION

The present invention accomplishes the above-stated objectives, as well as others, as may be determined by a fair reading and interpretation of the entire specification.

A leg stretch apparatus is provided for physical therapy, including a foot carriage mounted to a carriage guide track and permitting the foot carriage to move back and forth along a carriage path, for therapeutically stretching a user leg with reciprocating foot motion, and a user support structure pivotally connected the carriage track.

The apparatus preferably additionally includes user handle grips, and two elongate arm members pivotally connected to the carriage guide track, where the handle grips are connected to the elongate arm members. The user support structure preferably includes a platform structure including two parallel and laterally spaced apart beam members and a planar web member extending between and supported by the beam members.

The apparatus preferably additionally includes two cable and cable pulley mechanisms, each including a series of cables forming a cable loop extending along the user support structure, along the carriage guide track and along the arm members, and then back to the user support structure, and a series of pulleys rotatably mounted to the user support structure and to the carriage guide track for guiding the cable loop, the cable loop being connected to the foot carriage to reciprocate with the foot carriage.

The foot carriage preferably includes a foot securing structure for securing a user foot against substantial movement relative to the foot carriage. The carriage guide track preferably includes two substantially parallel and laterally spaced apart guide rails, each guide rail being tubular and longitudinally slotted, and a carriage guide member slidably contained within each guide rail, where the guide members are positioned to directly oppose each other, and where the carriage includes a carriage plate which is pivotally supported between the guide members by a carriage axle extending between guide members and through the carriage plate, and where the carriage plate includes a foot harness structure for receiving and securing a user foot.

The handle members are each pivotally connected to each arm member with a pivotal connection device. The connection device preferably includes a handle member pin and a pin flange extending longitudinally from the handle member into a flange slot in the corresponding arm member and the pivotal connection device includes a handle member pin extending laterally through the pin flange and arm member, and a longitudinal channel preferably passes through each handle member for slidably passing one loop of cable into the handle grip, where the cable is anchored against movement relative to the handle grip, such that the carriage and the handle grips reciprocate together. The apparatus preferably additionally includes a mechanism for releasably anchoring each handle grip against movement relative to the corresponding handle member.

BRIEF DESCRIPTION OF THE DRAWINGS

Various other objects, advantages, and features of the invention will become apparent to those skilled in the art from the following discussion taken in conjunction with the following drawings, in which:

FIG. 5 is a broken-away, sectional side view of an upright rear pulley housing portion of the support platform structure, revealing the cable directing and second beam member axle pulleys.

FIG. 6 is a top view of the carriage track and arm member portions of the apparatus, with external structure shown in broken lines and internal structure shown in solid lines.

FIG. 7 is a partial sectional top view of a handle member and handle grip structure FIG. 8 is a sectional side view of a handle member and handle grip structure.

FIG. 9 is a cross-sectional view of the structure of FIGS. 7 and 8, showing the U-shaped washer poised to engage and lock the handle grip into the handle member, and also shown a second time in locking position.

FIG. 10 is a sectional top view as in FIG. 7, but with the U-shaped washer and handle grip pin removed and poised for insertion into their respective slots and bores, and with the handle grip cap removed from the handle grip, thereby disengaging the second and third cables.

FIG. 11 is a sectional side view of the foot carriage, showing the opposing foot harnesses, one securing a user foot, and showing the carriage plate and the carriage axle.

FIG. 12 is a cross-sectional view of the carriage of FIG. 11.

FIG. 20 is a side view of the apparatus as in FIG. 1, additionally showing a user performing the leg reciprocating calf stretch in the standing position.

FIG. 21 is a side view of the apparatus reconfigured to pivot upwardly the carriage guide track and a user performing a backwardly and upwardly directed leg reciprocating stretch while on his chest. This stretch is a hip flex or quadricep stretch.

FIG. 22 is a side view of the apparatus as in FIG. 21 but with the carriage guide track further elevated and the arm members tilted downwardly toward the user head, and the user performing a forwardly and upwardly directed leg reciprocating hamstring stretch while on his back.

FIG. 23 is a partial side view of the apparatus showing a user doing an outwardly and horizontally directed leg reciprocation stretch while on his back, for post-surgical knee motion.

DETAILED DESCRIPTION OF THE PREFERRED EMBODIMENTS

Figure 1:
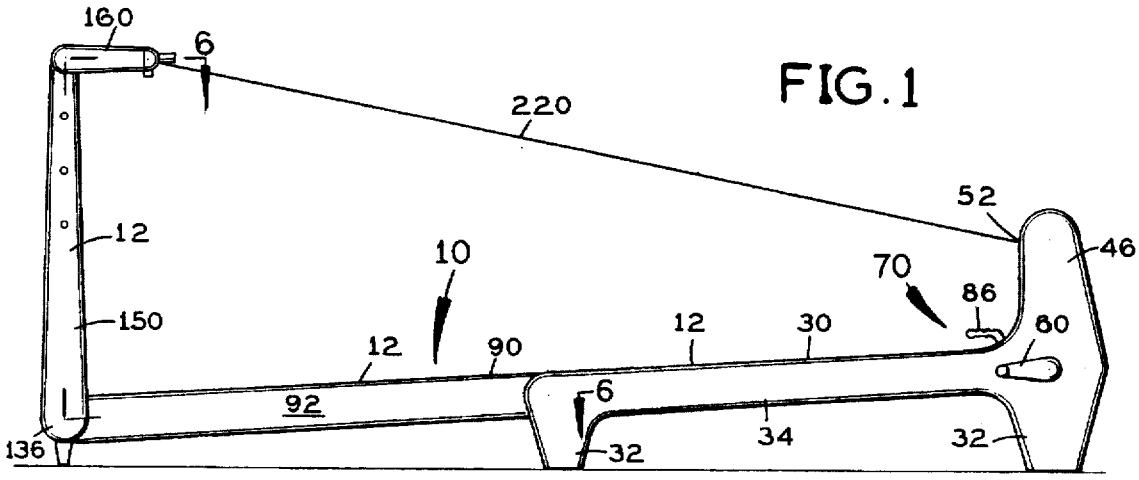
FIG. 1 is a side view of the apparatus unfolded for stretching with the user in either a walking position or a backwardly reclined position.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
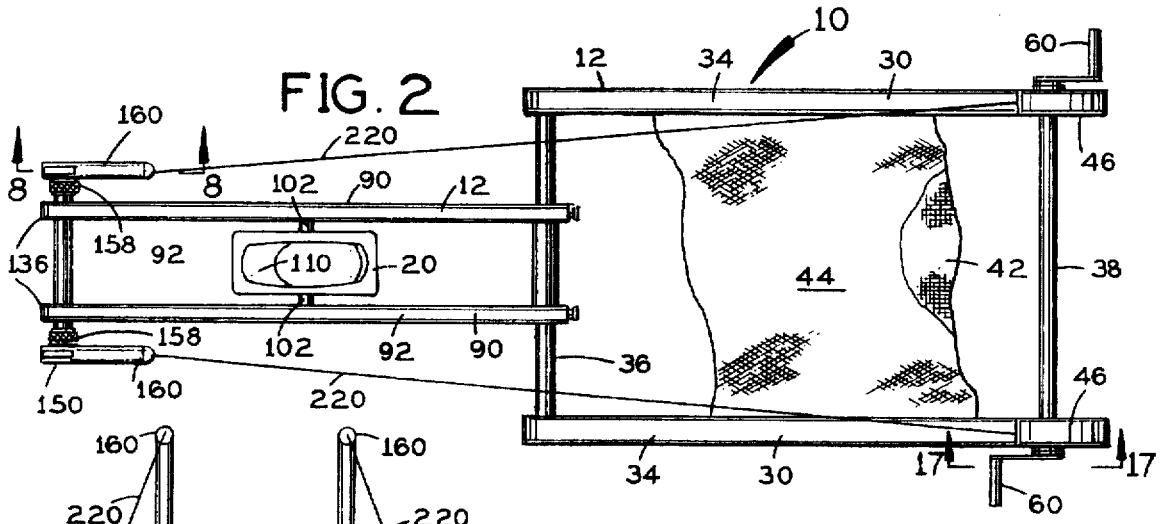
FIG. 2 is a top view of the apparatus of FIG. 1.
Figure 3:
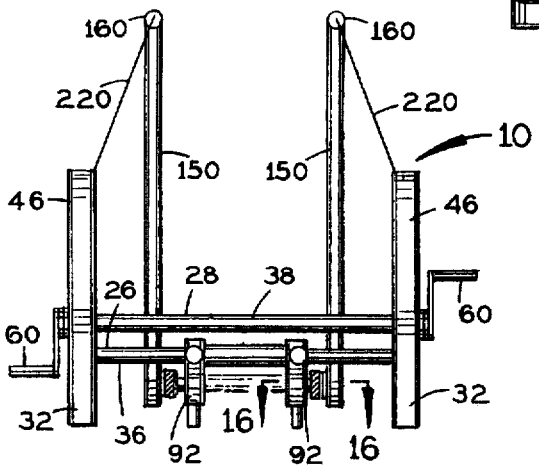
FIG. 3 is an end view of the apparatus seen from the platform end.
Figure 4:
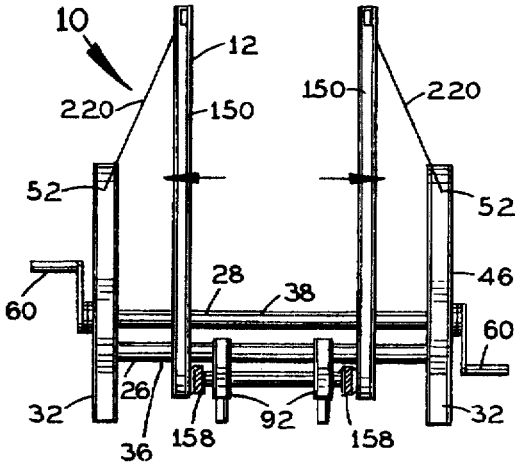
FIG. 4 is an end view of the apparatus seen from the arm member end.
Figure 13:
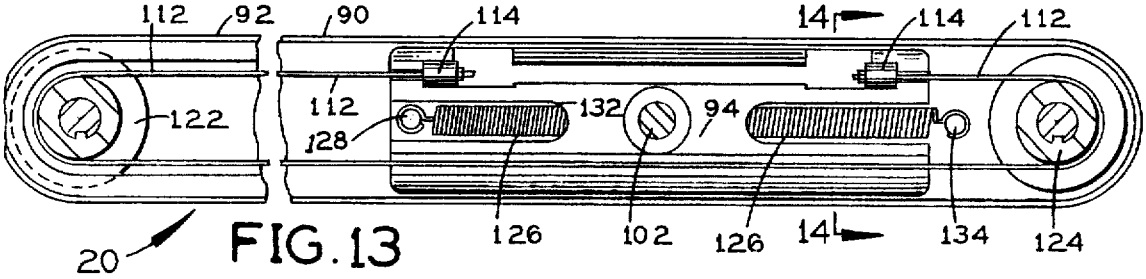
FIG. 13 is a sectional side view of a carriage guide rail and carriage guide member, revealing the first and third guide member cable connections and the guide member return spring.
Figure 15:
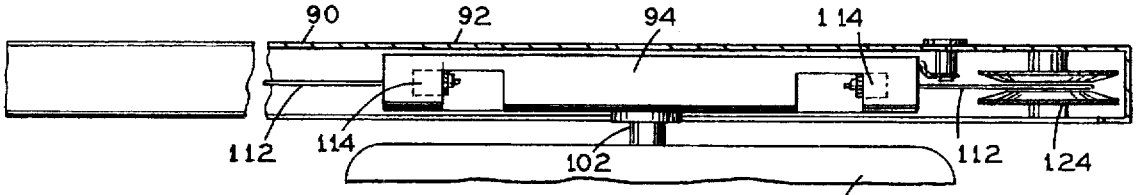
FIG. 15 is a sectional top view of a carriage guide rail, showing the carriage axle entering the carriage plate.
Figure 14:
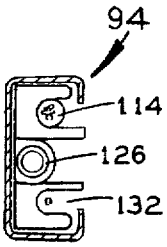
FIG. 14 is a cross-sectional view of a carriage guide member as in FIG. 13.
Figure 16:
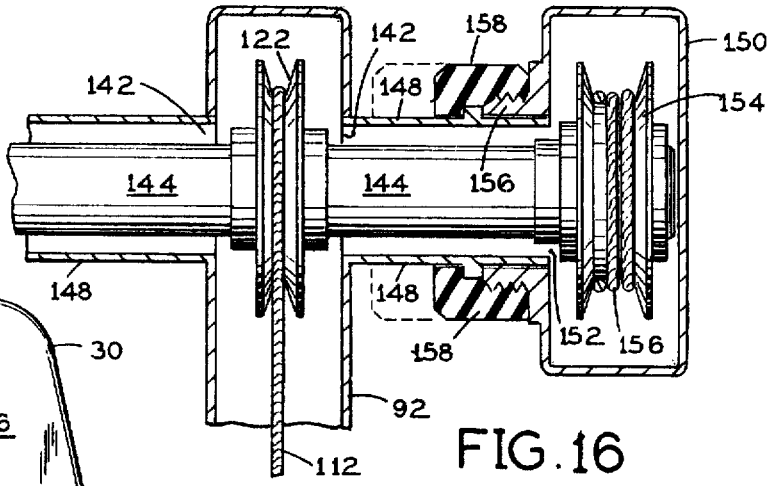
FIG. 16 is a sectional top view of the arm axle and axle housing, and the pulleys at one end, and of an arm member anchor fitting.
Figure 17:
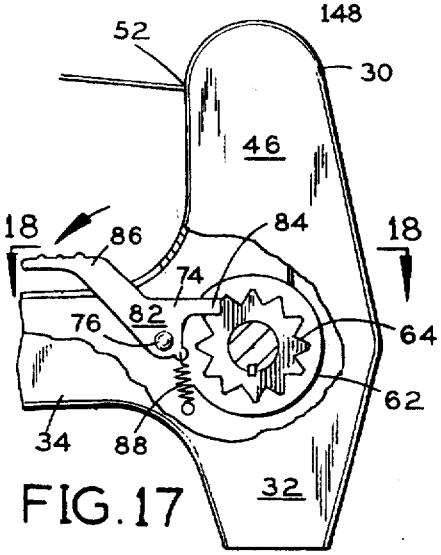
FIG. 17 is a partial side section of an upright rear pulley housing portion showing the lever pawl clutch mechanism.
Figure 18:
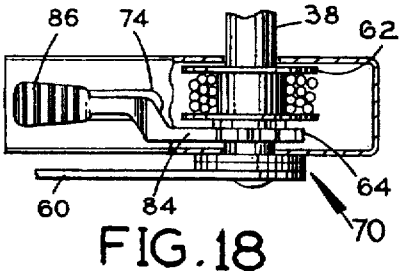
FIG. 18 is a sectional top view of the upright pulley housing portion of FIG. 17.
Figure 19:
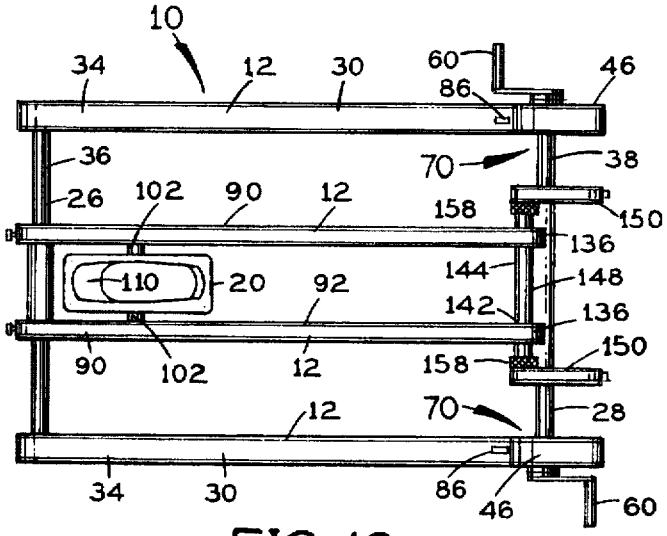
FIG. 19 is a top view of the platform with the carriage guide track folded on top of it and revealing the cable crank on the second beam member axle.

Referring to FIGS. 1–23, a leg stretch apparatus 10 is disclosed which provides a user body supporting frame 12 made up of several frame 12 portions which are pivotally inter-connected to permit reconfiguration of frame 12 to position the user body in any of several specific stretch poses, while presenting a slidable foot carriage 20 for guiding a user leg in a series of reciprocating leg movements.

Apparatus 10 includes a torso support platform 30 with platform legs 32 on which the user rests his or her chest or back for various stretches. See FIGS. 1 and 2. Platform 30 is made up of two parallel beam members 34 interconnected at opposing beam member 34 ends by first and second beam member axles 36 and 38. Axles 36 and 38 are each contained within housing tubes 26 and 28, respectively, to shield the user against contact with them. Housing tube 28 is welded or otherwise connected to the walls of beam members 34. A planar web member 42 is secured across beam members 34 and a cushion 44 is provided on top of web member 42. A first beam member axle 36 is fitted into axle ports in beam member 34 first ends to extend between and substantially perpendicular to beam members 34. Beam members 34 are elongate and hollow, and include upright rear pulley housing portions 46. Each pulley housing portion 46 includes a cable receiving port 52 at its upper end.

Within the upper end of each pulley housing portion 46 is a cable directing pulley 54 rotatably mounted on a housing axle 56. See FIG. 5. Below each cable directing pulley 54 and centered substantially in line with the given beam member 34 longitudinal axis is a second beam member axle pulley 62 mounted at an adjacent end of the second beam member axle 38, together with an axle crank 60. Crank 60 is used to gather or unwind a segment of cable 220 so that cable 220 remains taut regardless of which stretch configuration apparatus 10 is folded into. A pawl clutch mechanism 70 is provided at one end of second beam member axle 38 to secure support frame 12 in a fully folded, storage configuration. See FIG. 17. Clutch mechanism 70 includes a spur gear 64 mounted on axle 38 adjacent to one of the axle pulleys 62.

A pawl lever 74 is pivotally mounted on a lever pin 76 extending either into the beam member 34 walls or into lever mounting flanges (not shown) extending from beam member 34 wall inner surfaces. Lever 74 has a fulcrum portion 82 with a gear engaging prong 84 protruding in a rearward direction and with a foot depression segment 86 protruding in a forward direction. A coil spring 88 rotationally biases pawl lever 74 to engage spur gear 64 unless the bias is overcome by downward force on depression segment 86 by a user foot or an object of sufficient weight. Lever 74 must be held down, either by a therapist or by an object resting on it, during all stretches to release carriage 20.

To fold apparatus 10 for storage or transport, lever 74 is released to permit engagement of prong 84. Then either or both of cranks 60 are hand rotated to gather cable 220 and pull arm members 150 and carriage a track 90 around into a compact, folded configuration.

Pivotally extending from a first end of support platform 30 is foot carriage track 90, as mentioned above, which is made up of two parallel and laterally spaced apart guide rails 92. See FIG. 6. Guide rails 92 are tubular and longitudinally slotted along their directly opposing side wall portions, and a carriage guide member 94 is contained and slides within each rail 92. Carriage guide members 94 directly oppose each other, and a carriage plate 96 is pivotally supported between guide members 94 by a carriage axle 102 extending from one guide member 94, through carriage plate 96, and into the opposing guide member 94. See FIGS. 6, 11 and 12. The ends of the carriage axle 102 are each mounted in a ball bearing structure 104 within the rails 92. Carriage plate 96 has foot harness structures 110 on each plate 96 face, for receiving and engaging a user foot regardless of which face of carriage plate 96 is presented at any given moment. Guide members 94 are connected at each end to ends of a pair of first cables 112 with cable clamps 114, and each first cable 36 extends to first and second cable pulleys 122 and 124, respectively, at first and second rail 92 ends. A return spring 126 is preferably provided for each guide member 94 to bring the member 94 back to its initial location relative to the surrounding rail 92. See FIGS. 13–15. Return spring 126 may be a coil spring, as shown or a helical spring. One end of return spring 126 is fitted around a first stud 128 at a first end of guide member 94, then spring 126 extends through a longitudinal spring passageway 132 within the guide member 94, and the second spring 126 end is fitted around a second stud 134 on the tubular rail 92 interior surface.

Tubular rails 92 each terminate at a rail 92 first end with a closed end wall 136 and a registering handle axle mounting port 142 opens laterally through the rail 92 first ends. A handle axle 140 extends between rails 92 and through opposing mounting ports 142, so that each end of handle axle 144 protrudes out through rails 92.

A pair of elongate tubular arm members 150 each have a handle member second end having an axle mounting port 152. See FIGS. 2 and 6. Axle mounting ports 152 each fit over and receive the ends of the arm member axle 140, so that arm members 150 are pivotally mounted on arm axle 140. Each arm member 150 has a tubular lip portion 196 extending over an arm member axle 140 housing tube 148. Axle housing tubes 26 and 148 are both welded or otherwise connected to the walls of rails 92. An arm member anchor fitting 158 with internal threads engagingly fits onto each lip portion 146 to releasably abut and anchor each arm member 150 against pivoting, once apparatus 10 has been placed in a desired configuration. Another set of fittings (not shown) such as fittings 158 are provided to pivotally anchor beam members 24 relative axle housing tube 26. Arm member pulleys 154 for guiding a pair of second cables 156 are provided at the arm axle 140 ends inside arm members 150. Second cables 156 each wind around the arm member pulleys 154 several turns for frictionally securing the cables 156 and also for partial unwinding to extend cables 156 periodically during stretch repetitions. Second cables 156 run from the arm member pulleys 154 longitudinally through the hollow interiors of arm members 150 to a pivoting handle and grip structure 160 at each arm member 150 first end.

Each handle and grip structure 160 includes a handle member 162 pivotally connected to the first end of each arm member 150 with a handle member pin 164. See FIGS. 7–10. A rounded pin flange 166 extends longitudinally from each handle member 162 into a rounded flange slot 168 in the corresponding arm member 150 first end. Handle member pin 164 passes laterally through openings in the arm member 150 first end and through pin flange 166. A longitudinal channel 172 passes through each handle member 162 for slidably passing the corresponding second cable 156. A hollow cup recess 174 is provided in the free end of each handle member 162. A separate handle grip 180 is provided for each handle member 162 and has a narrow grip segment 182 which fits into the corresponding cup recess 174. A wider grip segment 184 abuts the rim of the cup recess 174 and provides an external grip surface for the user to hold onto for certain stretching exercises. The second cable 156 fits into and is fixedly engaged in the handle grip 180 so that the handle grip 180 reciprocates with the second cables 156.

A pair of opposing washer slots are provided in the handle member 162 outer surface, opening into the cup recess 174. A registering pair of opposing washer grooves are provided in opposing sides of the narrow grip segment 182, and a U-shaped washer 196 is provided for fitting into the registering washer slots and grooves to hold the handle grip 180 portions in the cup recess 174. U-shaped washer 196 is fitted in place to lock the handle grip 180 into the handle member 162 when apparatus 10 is not being used, or when the apparatus support frame 12 is being reconfigured to perform another stretch. When a stretch is to be performed, U-shaped washer 196 must be removed to free the handle grips 180 and thus to free the pairs of first and second cables 36 and 38, respectively, for the carriage 20 to reciprocate.

Handle grips 180 each include a cylindrical cable separation cap 202 having a narrow cap segment 204 fitting into a tubular recess 206 in the handle grip 180 free end. Cap 202 also has a wide cap segment 208 abutting the tubular recess 206 rim. Each cap 202 has an axial bore 212 for receiving and anchoring an end of the second cable 156. A cap retaining pin 214 removably passes through opposing pin ports 216 in the handle grip 180 wall and through a registering diametrical bore 218 in narrow cap segment 204. Cap retaining pins 214 are kept in place to anchor the caps 202 into handle grips 180 for performance of all stretches. Caps 202 are disengaged by removing cap retaining pins 214 to free the second cables 156 for apparatus 10 maintenance and storage.

As a user repeatedly slides carriage 20 forward and backward along guide rails 92, first cables 36 move with carriage 20 and rotate pulleys 122 and 124. Pulley 152 in turn extends and withdraws second cables 38, which causes handle grips 180 to slip in and out of handle members 162. A pair of third cables 220 extending from handle grips 180 into rear pulley housing portions 46, around pulleys 54 and around pulleys 62 and around a third pulley (not shown) on beam member axle 36 are also reciprocated.

Method

In practicing the invention, the following method may be used. A user may stand with one foot secured in carriage 20 and reciprocate carriage 20 and handle grips 180 with the force of his or her leg. See FIG. 20. A user may also lie on his or her back or sit on platform 30 and reciprocate the given foot in carriage 20. See FIG. 23. The user may swing carriage track 90 vertically upward and arm members 150 down toward rear pulley housing portions 46, and reciprocate a foot generally vertically. See FIG. 22. A user may also lie on his or her stomach and reciprocate the foot and leg while the leg is in a backwardly directed orientation. See FIG. 21. Still other stretching movements through operation of apparatus 10 are contemplated.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A leg stretch apparatus for physical therapy, comprising:

foot carriage means mounted to carriage guide means permitting said foot carriage means to move back and forth along a carriage path, for therapeutically stretching a user foot and user leg with reciprocating motion, and a user support means pivotally connected to said carriage guide means, user handle grip means, and two elongate arm members pivotally connected to said carriage guide means, wherein said handle grip means are connected to said elongate arm members.

2. An apparatus according to claim 1, wherein said user support means comprises a platform structure including two parallel and laterally spaced apart beam members and a planar web member extending between and supported by said beam members.

3. An apparatus according to claim 1, additionally comprising two cable and cable pulley means, each including a series of cables forming a cable loop extending along said user support means, along said carriage guide means and along said arm members, and then back to said user support means, and a series of pulleys rotatably mounted to said user support means and to said carriage guide means for guiding said cable loop, said cable loop being connected to said foot carriage means to reciprocate with said foot carriage means.

4. An apparatus according to claim 3, wherein said handle members are each pivotally connected to each said arm member with pivotal connection means.

5. An apparatus according to claim 4, wherein said connection means comprises a handle member pin and a pin flange extending longitudinally from the handle member into a flange slot in the corresponding arm member and wherein said pivotal connection means comprises a handle member pin extending laterally through said pin flange and arm member, and wherein a longitudinal channel passes through each said handle member for slidably passing one said loop of cable into said handle grip, wherein said cable is anchored against movement relative to said handle grip, such that said carriage means and said handle grips reciprocate together.

6. An apparatus according to claim 5, additionally comprising means for releasably anchoring each said handle grip against movement relative to the corresponding said handle member.

7. An apparatus according to claim 1, wherein said foot carriage means comprises foot securing means for securing a user foot against substantial movement relative to said foot carriage means.

8. An apparatus according to claim 1, wherein said carriage guide means comprises two substantially parallel and laterally spaced apart guide rails, each said guide rail being tubular and longitudinally slotted, and a carriage guide member slidably contained within each said guide rail, wherein said guide members are positioned to directly oppose each other, and wherein said carriage means includes a carriage plate which is pivotally supported between said guide members by a carriage axle extending between guide members and through said carriage plate, and wherein said carriage plate includes a foot harness structure for receiving and securing a user foot.

9. A leg stretch apparatus for physical therapy, comprising:

foot carriage means mounted to carriage guide means permitting said foot carriage means to move back and forth along a carriage path, for therapeutically stretching a user foot and user leg with reciprocating motion, and a user support means pivotally connected to said carriage guide means, wherein said carriage guide means comprises two substantially parallel and laterally spaced apart guide rails, each said guide rail being tubular and longitudinally slotted, and a carriage guide member slidably contained within each said guide rail, wherein said guide members are positioned to directly oppose each other, and wherein said carriage means includes a carriage plate which is pivotally supported between said guide members by a carriage axle extending between guide members and through said carriage plate, and wherein said carriage plate includes a foot harness structure for receiving and securing a user foot.

10. A leg stretch apparatus for physical therapy, comprising:

foot carriage means mounted to carriage guide means permitting said foot carriage means to move back and forth along a carriage path, for therapeutically stretching a user foot and user leg with reciprocating motion, a user support means pivotally connected to said carriage guide means, user handle grip means, two cable and cable pulley means, each including a series of cables forming a cable loop extending along said user support means, along said carriage guide means, and then back to said user support means, and means for guiding said cable loop, said cable loop being connected to said foot carriage means to reciprocate with said foot carriage means.

* * * * *